US005196068A

United States Patent [19]

Milner

[11] Patent Number: 5,196,068

[45] Date of Patent: Mar. 23, 1993

[54] MEANS FOR PRODUCING A HIGH BRIX LUMP-FREE MAGMA

[75] Inventor: Ted D. Milner, Westminster, Colo.

[73] Assignee: Silver Engineering Works, Inc., Aurora, Colo.

[21] Appl. No.: 887,401

[22] Filed: Nov. 18, 1991

Related U.S. Application Data

[63] Continuation of Ser. No. 619,644, Nov. 29, 1990, abandoned.

[51] Int. Cl.[5] ..... C13F 1/00; B04B 15/12; B04B 11/00

[52] U.S. Cl. ..... 127/2; 127/19; 127/56; 210/360.1; 210/380.1; 210/369; 494/22; 494/23; 494/27

[58] Field of Search ..... 127/19, 56; 210/360.1, 210/380.1, 369, 512.1; 494/22, 23, 27

[56] References Cited

U.S. PATENT DOCUMENTS

| | | | |
|---|---|---|---|
| 2,452,207 | 2/1944 | Olcott | 127/56 |
| 2,883,054 | 4/1959 | Sanchez | 127/19 |
| 3,226,257 | 12/1965 | Steele et al. | 127/19 |
| 3,730,769 | 5/1974 | Fiedler | 127/56 |
| 4,033,879 | 7/1977 | Natt et al. | 210/369 |
| 4,254,904 | 3/1981 | Ostermeyer et al. | 494/27 |
| 5,114,489 | 5/1992 | Milner et al. | 127/56 |

*Primary Examiner*—Theodore Morris
*Assistant Examiner*—P. L. Hailey
*Attorney, Agent, or Firm*—Robert F. Palermo; Bernard J. Murphy; Walter C. Vliet

[57] ABSTRACT

A water-conducting lance, fitted with a spray nozzle at an end thereof, is fixed to the top of a massecuite-separating centrifuge which has a rotating basket, to dispose the nozzle in adjacency to the top of the basket. The nozzle addresses the top of the basket, perpendicularly, and sprays pre-wetting water onto sugar crystals thereat, to insure a good mix of the crystals with subsequent mixing liquid (also water) in a mixing liquid zone, in order that a lump-free high brix magma will be produced.

6 Claims, 2 Drawing Sheets

MEANS FOR PRODUCING A HIGH BRIX LUMP-FREE MAGMA

This application is a continuation of application Ser. No. 07/619,644, filed Nov. 29, 1990 now abandoned.

BACKGROUND OF THE INVENTION

This invention pertains, generally, to massecuite-separating centrifuges which have rotating baskets, and in particular to means, in such centrifuges, for producing a high brix, lump-free magma.

Massecuite-separating centrifuges are well known in the prior art, and exemplary thereof is U.S. Pat. No. 4,052,304, issued on Oct. 4, 1977, to Mathieu J. Vertenstein. The same, aforesaid patent is incorporated herein, by reference, for a general understanding of such centrifuges.

It is desirable to produce a high brix magma which is lump-free. Sugar crystals which, in a rotating-basket, massecuite-separating centrifuge, gain the top of the basket are very dry. It will occur that, even as the crystals pass through the conventional mixing liquid zone, to be thrown into the mixing ring, they will still be insufficiently wetted. As a consequency, the magma produced by the mixing of the sugar crystals with the mixing liquid will have dry lumps.

SUMMARY OF THE INVENTION

To overcome the aforesaid problems, it is particularly an object of this invention to disclose, in a massecuite-separating centrifuge which has a rotating basket, means for producing a high brix, lump-free magma, said means comprising a conduit coupled to said centrifuge with a first portion thereof external to said centrifuge, and a second portion thereof disposed in adjacency to the inner top of the rotating basket; and means joined to said conduit for conducting water from said conduit onto said inner top of said basket for wetting sugar crystals.

Further objects of this invention, as well as the novel features thereof, will become apparent by reference to the following description, taken in conjunction with the accompanying figures.

BRIEF DESCRIPTION OF THE DRAWING FIGURES

FIG. 1 is an illustration, partly cross-sectioned, of a rotating-basket, massecuite-separating centrifuge, in which an embodiment of the invention is incorporated; and FIG. 2 is an elevational view of the nozzle-bearing lance, shown in association with a phantomed portion of the basket and the top of the centrifuge.

DETAILED DESCRIPTION

Figure 1:
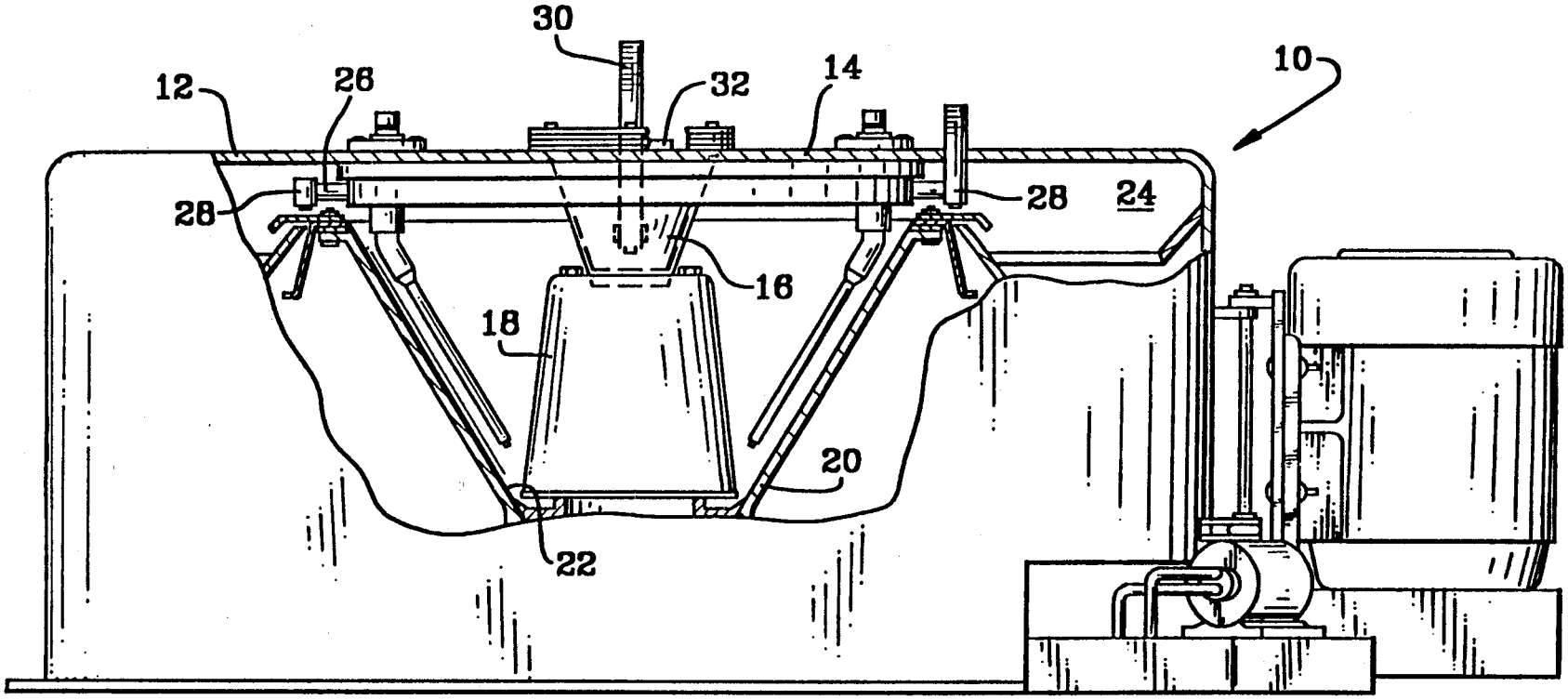

As shown in FIG. 1, a rotating-basket, massecuite-separating centrifuge 10 comprises a housing 12 having an upper cover 14 with a central opening in which a nested pair of massecuite-admitting cones 16 are fixed. The cones 16 open into the accelerator bell 18. Coupled to, and set about the bell 18, is the rotating basket 20. The centrifuge 10 operates in the usual, well known manner to separate sugar crystals from molasses. The molasses passes through a screen 22 carried by the basket 20, and the sugar crystals travel up the screen 22 to the top of the basket 20. As the sugar crystals centrifugally pass from the top of the basket 20 to the standard magma ring 24, they are sprayed with mixing liquid. An annular piping 26, which is supplied with hot water at approximately one hundred and fifty degrees F., conducts the water to spray nozzles 28. The nozzles 28 wet the sugar crystals, as they pass thereunder, the same being a so-called liquid mixing zone. Then the wetted crystals and hot water, mixing liquid centrifuge into the magma ring 24 in the form of magma. As noted, earlier, however, if the sugar crystals are not sufficiently wetted, as will occur because they pass through the liquid mixing zone quite rapidly, the magma produced will have dry lumps therein.

Figure 2:
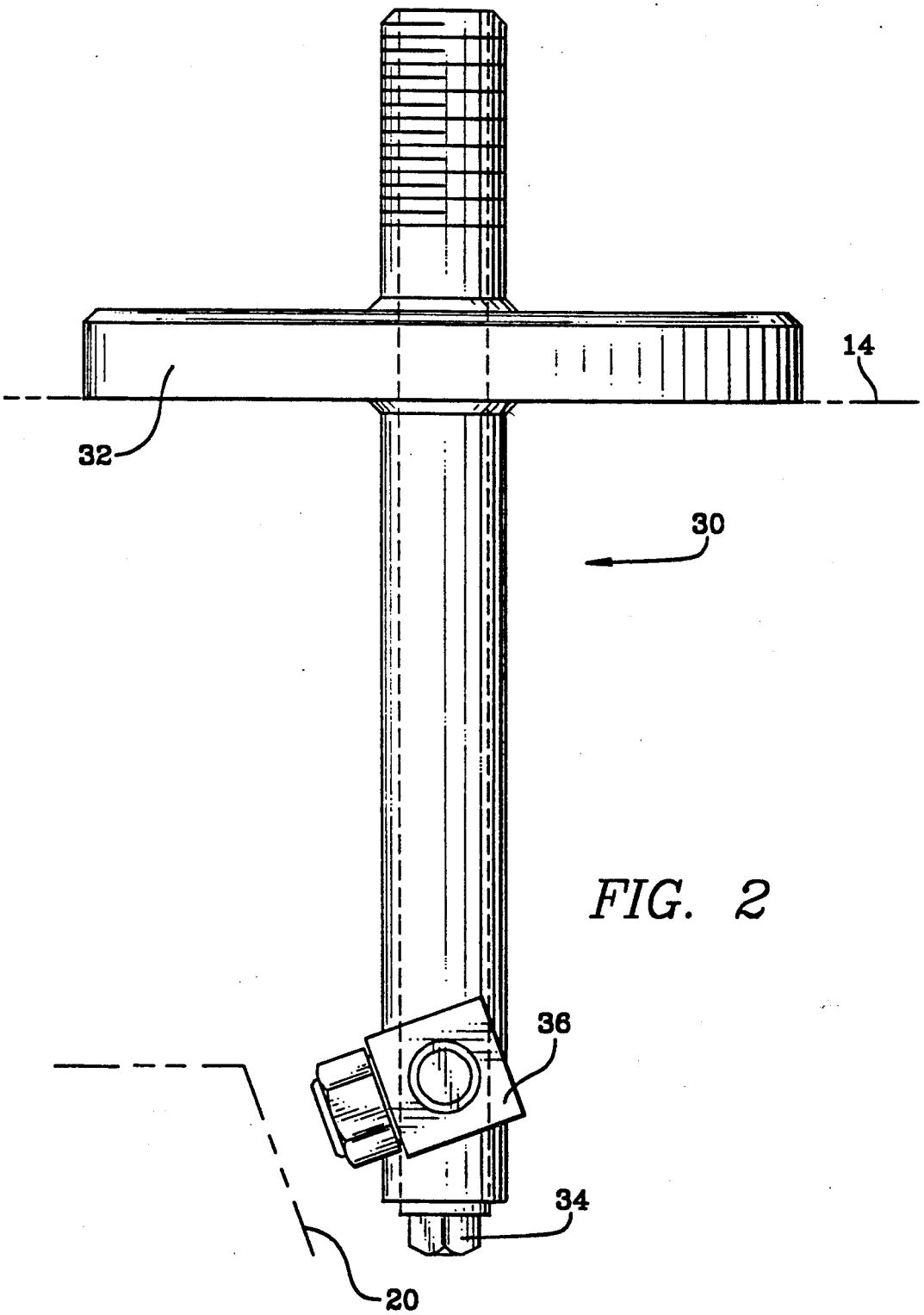

The instant invention obviates the lump-forming problem by pre-wetting the sugar crystals before they reach the liquid mixing zone under the nozzles 28. To this end, a lance 30, having a mounting bolt flange 32 (FIG. 2), is bolted to the cover 14. An outermost portion of the lance 30, which lance is a conduit for water, is externally threaded for coupling thereof to a source of water. The innermost portion of the lance 30 is disposed in adjacency to the innermost, top of the basket 20. The innermost end of the lance 30 is closed off with a plug 34, and near the plugged end thereof is coupled a spray nozzle 36. The nozzle 36 is so oriented that it sprays the water onto the innermost top of the basket 20 substantially perpendicular to the basket surface thereat.

The centrifugal force on the sugar crystals, whereat the nozzle 36 sprays them with water, is from fifteen hundred to twenty-six hundred Gs. Consequently, the prewetting of the sugar crystals can be done with a relatively small quantity of water. Yet, when the prewetted sugar enters the mixing liquid zone, under the nozzles 28, the mixing liquid (water) and crystals readily mix to form a uniform, lump-free magma in the magma ring 24.

The lance 30 and nozzle 36 are configured to pass a gallon of water per minute, however, in the practice of the invention, the quantity sprayed onto the inner top of the basket, for pre-wetting of the sugar crystals, is from approximately one-tenth to two-tenths of a gallon per minute.

While I have described my invention in connection with a specific embodiment thereof, it is to be clearly understood that this is done only by way of example, and not as a limitation to the scope of the invention as set forth in the objects thereof and in the appended claims.

I claim:

1. In a massecuite-separating centrifuge which has (a) a rotating basket having a frustoconic form with an open divergent upper extremity, and (b) a magma ring, about said basket, for receiving magma from said upper extremity of said basket, means for producing a high brix, lump-free magma, said means comprising:

a conduit coupled to said centrifuge with a first portion thereof external to said centrifuge, and a second portion thereof disposed adjacent to the inner top of the basket; and means joined to said conduit for conducting water from said conduit only onto said upper extremity of said basket for wetting sugar crystals, thereat, which subsist in magma, before discharge of magma from said basket to said magma ring.

2. Means for producing a high brix, lump-free magma, according to claim 1, wherein:

said water-conducting means comprises a spray nozzle.

3. Means for producing a high brix, lump-free magma, according to claim 2, wherein:

said nozzle is so oriented, relative to said inner edge of the upper extremity of said basket, as to expel water onto said inner edge of said basket perpendicularly thereto.

4. Means for producing a high brix, lump-free magma, according to claim 1, wherein:

said water-conducting means comprises a nozzle coupled to said second portion of said conduit.

5. Means for producing a high brix, lump-free magma, according to claim 1, wherein:

said conduit and said nozzle are configured to pass approximately one gallon of water per minute therethrough.

6. Means for producing a high brix, lump-free magma, according to claim 1, wherein:

said first portion has a terminal end which is externally threaded, for coupling thereof to a source of water, and said second portion has a terminal end which is sealingly plugged.

* * * * *